US008940134B2

(12) United States Patent
Ishihara et al.

(10) Patent No.: US 8,940,134 B2
(45) **Date of Patent: *Jan. 27, 2015**

(54) PAPER COMPRISING HEAT TREATED BIO-SOLUBLE INORGANIC FIBERS, AND METHOD AND EQUIPMENT FOR MAKING SAME

(75) Inventors: Tetsuya Ishihara, Tokyo (JP); Tetsuya Mihara, Tokyo (JP); Ken Yonaiyama, Tokyo (JP); Tomohiko Kishiki, Tokyo (JP)

(73) Assignee: Nichias Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/064,643

(22) Filed: Apr. 5, 2011

(65) Prior Publication Data

US 2012/0255697 A1 Oct. 11, 2012

(51) Int. Cl.
*D21H 13/36* (2006.01)
*D21H 13/40* (2006.01)
*D21H 27/00* (2006.01)

(52) U.S. Cl.
CPC ..... *D21H 13/36* (2013.01); *D21H 13/40* (2013.01)
USPC ..... 162/156; 162/145; 162/158; 162/9; 428/221; 428/364

(58) Field of Classification Search
CPC ..... D21H 13/36; D21H 13/38; D21H 13/46; D21H 13/40; D04H 1/4218; D04H 1/488; D04H 1/4209; Y10S 428/92; Y10S 428/921
USPC ..... 162/141, 145, 152, 156, 158, 164.1, 162/168.1, 207; 428/221, 292.1, 293.4, 428/296.7, 300.4, 359, 364
See application file for complete search history.

(56) References Cited

U.S. PATENT DOCUMENTS

| | | | | |
|---|---|---|---|---|
| 4,487,657 | A * | 12/1984 | Gomez | 162/158 |
| 4,612,251 | A * | 9/1986 | Fredenucci et al. | 428/511 |
| 5,250,269 | A | 10/1993 | Langer | |
| 5,332,699 | A * | 7/1994 | Olds et al. | 501/36 |
| 5,585,312 | A * | 12/1996 | TenEyck et al. | 501/35 |
| 5,714,421 | A * | 2/1998 | Olds et al. | 501/36 |
| 5,767,022 | A * | 6/1998 | Clere et al. | 442/101 |
| 5,811,360 | A * | 9/1998 | Jubb | 501/35 |
| 5,821,183 | A * | 10/1998 | Jubb | 501/36 |
| 5,874,375 | A * | 2/1999 | Zoitos et al. | 501/36 |
| 5,932,347 | A * | 8/1999 | Rapp et al. | 428/392 |
| 5,955,389 | A * | 9/1999 | Jubb | 501/36 |
| 6,025,288 | A * | 2/2000 | Zoitos et al. | 501/36 |
| 6,030,910 | A * | 2/2000 | Zoitos et al. | 501/36 |
| 6,294,491 | B1 * | 9/2001 | Fay et al. | 501/35 |
| 6,627,568 | B2 | 9/2003 | Kusuno et al. | 501/36 |
| 6,703,103 | B2 * | 3/2004 | Tanaka et al. | 428/116 |
| 6,861,381 | B1 * | 3/2005 | Jubb et al. | 501/35 |
| 6,953,757 | B2 * | 10/2005 | Zoitos et al. | 501/35 |
| 7,153,796 | B2 * | 12/2006 | Jubb et al. | 501/36 |
| 7,259,118 | B2 * | 8/2007 | Jubb et al. | 501/36 |
| 7,749,923 | B2 * | 7/2010 | Moore et al. | 442/23 |
| 7,767,597 | B2 * | 8/2010 | Garvey | 442/2 |
| 8,007,732 | B2 * | 8/2011 | Beauharnois | 422/179 |
| 8,308,837 | B2 * | 11/2012 | Okabe | 55/523 |
| 2003/0072914 | A1 | 4/2003 | Tanaka et al. | 428/116 |
| 2003/0130104 | A1 * | 7/2003 | Kusuno et al. | 501/35 |
| 2008/0166937 | A1 * | 7/2008 | Garvey | 442/1 |
| 2010/0115931 | A1 * | 5/2010 | Okabe | 60/299 |
| 2010/0173552 | A1 * | 7/2010 | Fernando et al. | 442/414 |
| 2010/0209306 | A1 * | 8/2010 | Kunze et al. | 422/122 |
| 2011/0079746 | A1 * | 4/2011 | Fernando et al. | 252/62 |
| 2011/0150715 | A1 * | 6/2011 | Kumar | 422/168 |
| 2011/0247839 | A1 * | 10/2011 | Lalouch et al. | 169/45 |
| 2011/0248420 | A1 * | 10/2011 | Cordts et al. | 264/115 |
| 2011/0250461 | A1 * | 10/2011 | Frost et al. | 428/446 |
| 2011/0311404 | A1 * | 12/2011 | Creedon et al. | 422/177 |
| 2012/0039756 | A1 * | 2/2012 | Beauharnois | 422/168 |
| 2012/0100983 | A1 * | 4/2012 | Yonaiyama et al. | 501/153 |
| 2012/0107547 | A1 * | 5/2012 | Fernando et al. | 428/76 |
| 2012/0247695 | A1 * | 10/2012 | Mihara et al. | 162/3 |
| 2012/0255697 | A1 * | 10/2012 | Ishihara et al. | 162/164.6 |

FOREIGN PATENT DOCUMENTS

| | | | |
|---|---|---|---|
| CN | 1544371 | A | 11/2004 |
| EP | 707889 | A1 * | 4/1996 |
| EP | 2634308 | A1 * | 9/2013 |
| GB | 2348640 | A * | 10/2000 |
| GB | 2383793 | A * | 7/2003 |
| JP | 10-512232 | | 11/1998 |
| JP | 2002-68777 | | 3/2002 |
| JP | 2002-266169 | | 9/2002 |

(Continued)

OTHER PUBLICATIONS

Machine Translation JP 2006-152468 A, published on Jun. 15, 2006.*

(Continued)

*Primary Examiner* — Jose Fortuna
(74) *Attorney, Agent, or Firm* — Steptoe & Johnson LLP

(57) ABSTRACT

Inorganic fiber paper including bio-soluble inorganic fibers which have been subjected to a heat treatment and a binder. A method for producing inorganic fiber paper including: the first step of subjecting amorphous bio-soluble inorganic fibers to a heat treatment; and the second step of making paper comprising the heat-treated bio-soluble inorganic fibers and a binder. Equipment for heating and/or thermal insulation which includes the inorganic fiber paper.

7 Claims, 1 Drawing Sheet

(56) References Cited

FOREIGN PATENT DOCUMENTS

| | | | | |
|---|---|---|---|---|
| JP | 2002266169 | A | | 9/2002 |
| JP | 2003-105662 | | | 4/2003 |
| JP | 2004-036050 | | | 2/2004 |
| JP | 2005-089913 | | | 4/2005 |
| JP | 2005-515307 | | | 5/2005 |
| JP | 2006-089881 | | | 4/2006 |
| JP | 2006-152468 | | | 6/2006 |
| JP | 2011042575 | A | * | 3/2011 |
| JP | 4977253 | B1 | * | 7/2012 |
| JP | 5015336 | B1 | * | 8/2012 |
| WO | WO 9415883 | A1 | * | 7/1994 |
| WO | WO 9602478 | A1 | * | 2/1996 |
| WO | WO 9606053 | A1 | * | 2/1996 |
| WO | WO 97/16386 | | | 5/1997 |
| WO | WO 9716386 | A1 | * | 5/1997 |
| WO | WO 03/060016 | A1 | | 7/2003 |
| WO | WO 2004/031544 | A2 | | 4/2004 |
| WO | WO 2008136875 | A1 | * | 11/2008 |
| WO | WO 2009018455 | A1 | * | 2/2009 |
| WO | WO 2010077360 | A2 | * | 7/2010 |
| WO | WO 2011083695 | A1 | * | 7/2011 |
| WO | WO 2012132327 | A1 | * | 10/2012 |
| WO | WO 2012132329 | A1 | * | 10/2012 |

OTHER PUBLICATIONS

Machine Translation of JP 2010-013773 A, published on Jan. 21, 2010.*

Machine Translation JP 2006-089881 A, published on Apr. 6, 2006.*

Machine Translation of JP 2002266169 A, Published on Sep. 2002.*

Ceramic Fiber and the Development of Insulating Technology—Shinnika Thermal Ceramics Corporation Head Office—2008.

Third Party Observations EP 12764960.6, Aug. 23, 2013.

* cited by examiner

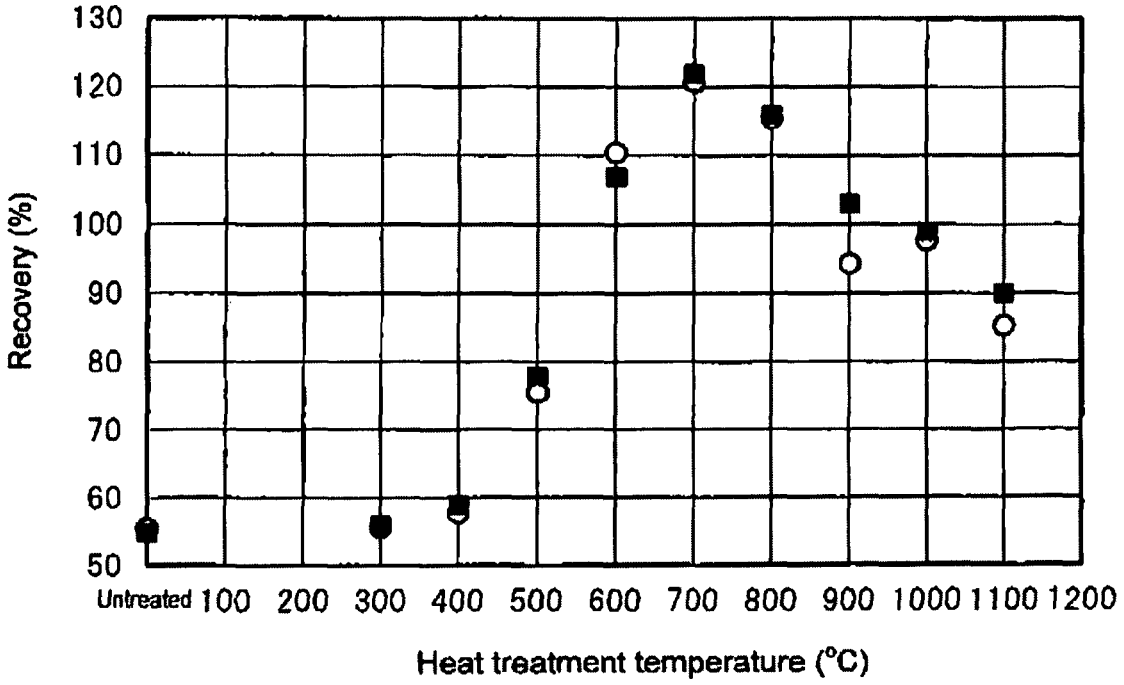
130
120
110
100
90
80
70
60
50
Recovery (%)
Untreated
100
200
300
400
500
600
700
800
900
1000
1100
1200
Heat treatment temperature (°C)

PAPER COMPRISING HEAT TREATED BIO-SOLUBLE INORGANIC FIBERS, AND METHOD AND EQUIPMENT FOR MAKING SAME

TECHNICAL FIELD

The invention relates to inorganic fiber paper, a method for producing the same and equipment using the same. In particular, the invention relates to improvement in recovery after compression heating of inorganic fiber paper containing bio-soluble inorganic fibers.

BACKGROUND ART

Inorganic fiber paper is lightweight, easy to handle and improved heat resistance, and hence, is used as a heat resisting sealing material, for example. On the other hand, in recent years, a problem has been pointed out that inorganic fibers are inhaled into a human body and the inhaled fibers invade the lung to cause disorders. Under such circumstances, bio-soluble inorganic fibers which do not cause or hardly cause disorders even if inhaled into a human body have been developed (Patent Document 1, identified below, for example).

RELATED ART DOCUMENTS

Patent Document

Patent Document 1: Japanese Patent Application Publication JP-A-2002-068777, published Mar. 8, 2002, of Japanese Patent Application 2000-257630, filed Aug. 28, 2000, to which U.S. Pat. No. 6,627,568 corresponds.

SUMMARY OF THE INVENTION

Subject to be Solved by the Invention

However, inorganic fiber paper containing conventional bio-soluble inorganic fibers as inorganic fibers has a problem that the recovery thereof after compression heating is poor.

The invention has been made in view of the above-mentioned subject, and an object thereof is to provide inorganic fiber paper improved in recovery after compression heating, a method for producing the same and equipment using the same.

Means for Solving the Subject

The inorganic fiber paper according to one embodiment of the invention for solving the above-mentioned subject comprises bio-soluble inorganic fibers which have been subjected to a heat treatment and a binder. According to the invention, it is possible to provide inorganic fiber paper which is improved in recovery after compression heating.

The inorganic fiber paper may have a recovery after compression heating of 60% or more.

A method for producing inorganic fiber paper according to one embodiment of the invention for solving the above-mentioned subject comprises the first step of subjecting amorphous bio-soluble inorganic fibers to a heat treatment; and the second step of making paper comprising the bio-soluble inorganic fibers which have been subjected to the heat treatment and a binder. According to the invention, it is possible to provide a method for producing inorganic fiber paper improved in recovery after compression heating.

In the heat treatment of the first step, the bio-soluble inorganic fibers may be heated at a temperature lower than the crystallization temperature thereof.

Equipment according to one embodiment of the invention for solving the above-mentioned subject is equipment for heating and/or heat insulation, and comprises the above-mentioned inorganic fiber paper. According to the invention, it is possible to provide equipment which has inorganic fiber paper excellent in recovery after compression heating.

Advantageous Effects of the Invention

According to the invention, it is possible to provide inorganic fiber paper improved in recovery after compression heating, a method for producing the same and equipment using the same.

BRIEF DESCRIPTION OF THE DRAWINGS

FIG. 1 is a view showing one example of the evaluation results of recovery of inorganic fiber paper after compression heating in the example according to one embodiment of the invention.

MODE FOR CARRYING OUT THE INVENTION

One embodiment of the invention will be described below. The invention is, however, not limited to this embodiment.

First, a method for producing inorganic fiber paper according to this embodiment (hereinafter referred to as the "method of the embodiment") will be described. The method of the embodiment comprises the first step of subjecting amorphous bio-soluble inorganic fibers to a heat treatment (hereinafter referred to as the "heat treatment step") and the second step of making inorganic fiber paper comprising the heat-treated bio-soluble inorganic fibers and a binder (hereinafter referred to as the "paper-making step").

In the heat treatment step, first, amorphous bio-soluble inorganic fibers are prepared. No specific restrictions are imposed on bio-soluble inorganic fibers insofar as they are inorganic fibers and have bio-solubility (property of being decomposed in a living body even if they are inhaled into the lung of the living body, for example). At least part of the bio-soluble inorganic fibers is amorphous, and the amorphous nature can be confirmed by X-ray powder diffraction (XRD) measurement.

Bio-soluble inorganic fibers are inorganic fibers having a physiological saline dissolution ratio at 40° C. of 1% or more, for example.

The physiological saline dissolution ratio can be measured by the following method, for example. Specifically, at first, 1 g of a sample obtained by pulverizing inorganic fibers to 200 meshes or less and 150 mL of a physiological saline solution are charged in a conical flask (volume: 300 mL) and the flask is installed in an incubator at 40° C. Next, the conical flask is continuously subjected to horizontal vibration of 120 rotations per minute for 50 hours. Subsequently, the concentrations of elements (mg/L) contained in a filtrate obtained by filtration are each measured by means of an ICP emission spectroscopic analyzer. Then, the physiologically saline dissolution ratio (%) is calculated based on the measured concentrations of the elements and the contents (mass %) of the elements in inorganic fibers before dissolution. Specifically, if the elements subjected to the measurement are silicon (Si), magnesium (Mg), calcium (Ca) and aluminum (Al), the physiologically saline dissolution ratio C (%) is calculated according to the following formula:

C (%)=[Amount of filtrate (L)×(a1+a2+a3+a4)×100]/[Mass of inorganic fibers before dissolution (mg)×(b1+b2+b3+b4)/100]. In this formula, a1, a2, a3 and a4 are the measured concentrations (mg/L) of silicon, magnesium, calcium and aluminum, respectively, and b1, b2, b3 and b4 are the contents (mass %) of silicon, magnesium, calcium and aluminum contained in inorganic fibers before dissolution, respectively.

The $SiO_2$ content of the bio-soluble inorganic fibers may be 50 to 82 mass %, for example. The $SiO_2$ content is preferably 63 to 81 mass %, more preferably 66 to 80 mass %, and further preferably 71 to 76 mass %. That is, the bio-soluble inorganic fibers are inorganic fibers in which the $SiO_2$ content is 50 to 82 mass % and the total of the CaO content and the MgO content is 10 to 40 mass %, for example. The total of the CaO content and the MgO content is preferably 18 to 40 mass %, more preferably 20 to 34 mass %. These ranges of the total of the CaO content and the MgO content can be arbitrarily combined with the range of $SiO_2$ content as mentioned above. When the $SiO_2$ content of bio-soluble inorganic fibers is in the above-mentioned range, in addition to the solubility in a living body, the bio-soluble inorganic fibers can have improved heat resistance.

The CaO content of the bio-soluble inorganic fibers may be 10 to 34 mass %, for example. That is, the bio-soluble inorganic fibers may be inorganic fibers in which the $SiO_2$ content is 50 to 82 mass % and the CaO content is 10 to 34 mass % (hereinafter, sometimes referred to as the "$SiO_2$/CaO fibers"). The CaO content is preferably 12 to 35 mass %, more preferably 21 to 26 mass %. These ranges of the CaO content can be arbitrarily combined with the range of the $SiO_2$ content as mentioned above and the range of the total of the CaO content and the MgO content as mentioned above.

The MgO content of the bio-soluble inorganic fibers may be 1 mass % or less (that is, 0 to 1 mass %), for example. That is, the bio-soluble inorganic fibers may be $SiO_2$/CaO fibers in which the $SiO_2$ content is 60 to 82 mass %, the CaO content is 10 to 34 mass % and the MgO content is 1 mass % or less. The MgO content is preferably 0.9 mass % or less, more preferably 0.8 mass % or less. These ranges of the MgO content can be arbitrarily combined with the range of the $SiO_2$ content as mentioned above, the range of the total of the CaO content and the MgO content as mentioned above and the range of the CaO content as mentioned above.

The MgO content of the bio-soluble inorganic fibers may be larger than 1 mass % and 20 mass % or less. That is, the bio-soluble inorganic fibers may be inorganic fibers in which the $SiO_2$ content is 50 to 82 mass % and the MgO content is larger than 1 mass % and 20 mass % or less. The MgO content is preferably 2 to 19 mass %, more preferably 3 to 19 mass %. These ranges of the MgO content can be arbitrarily combined with the range of the $SiO_2$ content as mentioned above and the total of the range of the CaO content and the MgO content as mentioned above.

The bio-soluble inorganic fibers may be bio-soluble inorganic fibers (hereinafter, often referred to as the "$SiO_2$/MgO fibers") In which the $SiO_2$ content is 50 to 82 mass % (preferably 72 to 80 mass %), the MgO content is 9 to 31 mass % (preferably 14 to 22 mass %) and the CaO content of 1 to 9 mass % (preferably 1 to 8 mass %), for example.

For the bio-soluble inorganic fibers, the total of the $SiO_2$ content, the MgO content and the CaO content may be 97 mass % or more (that is, 97 to 100 mass %), for example. The total of the $SiO_2$ content, the MgO content and the CaO content is preferably 97.5 mass % or more, more preferably 98 mass % or more. These ranges of the $SiO_2$ content, the total of the MgO content and the CaO content can be arbitrarily combined with the range of the $SiO_2$ content as mentioned above, the range of the total of the CaO content and the MgO content as mentioned above, the range of the CaO content as mentioned above and the range of the MgO content as mentioned above.

The bio-soluble inorganic fibers may or may not contain other components in addition to $SiO_2$ and alkali earth metal oxides (at least one of MgO and CaO, for example). That is, the bio-soluble inorganic fibers may or may not further contain one or two or more selected from alumina ($Al_2O_3$), titania ($TiO_2$), zirconia ($ZrO_2$), iron oxide ($Fe_2O_3$), manganese oxide (MnO) and potassium oxide ($K_2O$).

Specifically, if the bio-soluble inorganic fibers contain $Al_2O_3$, the $Al_2O_3$ content may be 5 wt % or less, 3.5 wt % or less or 3 wt % or less, for example. Further, the $Al_2O_3$ content may be 1 wt % or more or 2 wt % or more. The $Al_2O_3$ content is preferably 0 to 3 mass %, more preferably 1 to 3 mass %. If the bio-soluble inorganic fibers contain $Al_2O_3$ in these ranges, the fibers have improved fire resistance and appropriate water solubility, and hence, are easily processed. In this case, in the bio-soluble inorganic fibers, the total of the $SiO_2$ content, the MgO content, the CaO content and the $Al_2O_3$ content may be 98 mass % or more (that is, 98 to 100 mass %) or 99 mass % or more (that is, 99 to 100 mass %).

Specifically, the bio-soluble inorganic fibers with the following composition can be exemplified.

Total of $SiO_2$, $Al_2O_3$, $ZrO_2$ and $TiO_2$: 50 to 82 wt %

Total of CaO and MgO: 18 to 50 wt %

Further, the bio-soluble inorganic fibers with the following composition can be exemplified.

$SiO_2$: 50 to 82 wt %

Total of CaO and MgO: 10 to 43 wt %

Bio-soluble inorganic fibers can be roughly divided into Mg silicate fibers containing a large amount of MgO and Ca silicate fibers containing a large amount of CaO. As the Mg silicate fibers, the following compositions can be exemplified.

$SiO_2$: 66 to 82 wt %

CaO: 1 to 9 wt %

MgO: 10 to 30 wt %

$Al_2O_3$: 3 wt % or less

Other oxides: less than 2 wt %

As the Ca silicate fibers, the following compositions can be exemplified. The fibers with the following compositions are improved in bio-solubility after heating and fire resistance.

$SiO_2$: 86 to 82 wt % (68 to 80 wt %, 70 to 80 wt %, 71 to 80 wt % or 71 to 78 wt %, for example)

CaO: 10 to 34 wt % (20 to 30 wt % or 21 to 26 wt %, for example)

MgO: 3 wt % or less (1 wt % or less, for example)

$Al_2O_3$: 5 wt % or less (3.5 wt % or less or 3 wt % or less, for example. Further, it may be 1 wt % or more or 2 wt % or more)

Other oxides: less than 2 wt %

The above-mentioned bio-soluble inorganic fibers may or may not contain, as other components, one or more selected from alkaline metal oxides ($K_2O$, $Na_2O$ or the like), $Fe_2O_3$, $ZrO_2$, $TiO_2$, $P_2O_4$, $B_2O_3$, $R_2O_3$ (R is selected from Sc, La, Ce, Pr, Nd, Sm, Eu, Gd, Tb, Dy, Ho, Er, Tm, Yb, Lu, Y or mixtures thereof). The content of each of other oxides may be 0.2 wt % or less or 0.1 wt % or less.

No specific restrictions are imposed on the average fiber diameter of the bio-soluble inorganic fibers as long as it is within a range which allows inorganic fiber paper to be produced properly, and, for example, it is 1 to 10 μm, preferably 2 to 6 μm. If the average fiber diameter is less than 1 μm, the strength of the inorganic fiber paper tends to be lowered since the bio-soluble inorganic fibers tend to break easily. Further, if the average diameter exceeds 10 μm, the strength of the inorganic fiber paper tends to be lowered since the density of the inorganic fiber paper becomes too small.

No specific restrictions are imposed on the average fiber length of the bio-soluble inorganic fibers as long as it is within a range which allows inorganic fiber paper to be produced properly, and, for example, it is 1 to 200 mm, preferably 1 to 100 mm. When the average fiber length is within the above-mentioned range, inorganic fiber paper having an appropriate density can be produced easily.

Subsequently, in the heat treatment step, the amorphous bio-soluble inorganic fibers as prepared above (hereinafter referred to as the "untreated fibers") are subjected to a heat treatment, whereby the bio-soluble inorganic fibers which have been subjected to the heat treatment (hereinafter referred to as the "heat-treated fibers") are obtained.

No specific restrictions are imposed on the heat treatment conditions (temperature and time, for example) as long as the recovery after compression heating of the inorganic fiber paper containing the heat-treated fibers becomes higher than that of the inorganic fiber paper containing untreated fibers instead of the heat-treated fibers.

Here, the recovery after heat compression is the ratio of recovery in the thickness of the inorganic fiber paper after heating it in the compressed state (that is, in a state in which the thickness of the inorganic fiber paper is decreased) (the ratio of the thickness after compression heating to the thickness before compression heating).

That is, the heat treatment is conducted under conditions where the recovery after subjecting the inorganic fiber paper containing the heat-treated fibers to heating at 500° C. for 3 hours in the compressed state in which the thickness is reduced by 50% becomes higher than that of the inorganic fiber paper containing untreated fibers (under conditions such that the recovery is 60% or more, for example).

An example of the heating temperature in the heat treatment (hereinafter, referred to as the "heat treatment temperature") is 300 to 1300° C., preferably 300 to 1100° C., more preferably 400 to 1100° C., and further preferably 500 to 1100° C. For example, the heat treatment temperature is 500 to 1100° C., and preferably 500 to 900° C.

When the bio-soluble inorganic fibers are heated at a temperature higher than the crystallization temperature thereof to allow part of the bio-soluble inorganic fibers to be crystallized, the bio-solubility after heating may be decreased than that before heating.

Thus, in the heat treatment, untreated fibers may be heated at a temperature lower than the crystallization temperature thereof. The crystallization temperature of the untreated fibers is measured by TG-DTA (thermogravimetric analysis-differential thermal measurement), for example. Since the crystallization temperature varies depending on the chemical composition of the untreated fibers, the heat-treatment temperature lower than the crystallization temperature cannot be determined concretely.

Therefore, the heat treatment temperature may be lower than the crystallization temperature and 300° C., 400° C. or 500° C. or higher. By conducting the heat treatment at a temperature lower than the crystallization temperature, lowering in bio-solubility of the heat-treated fibers is avoided effectively, and the heat-treated fibers become hardly embrittled.

The inorganic fiber paper comprising heat-treated fibers which have been subjected to a heat treatment at a relatively high temperature may have a recovery after the compression heating exceeding 100%.

The heat treatment temperature may be in such a range that the recovery of the inorganic fiber paper containing heat-treated fibers after heat compression (for example, the recovery after heating at 500° C. for 3 hours in the compressed state such that the thickness thereof is reduced by 50%, for example) becomes 100% or less. A recovery of 100% or less is preferable since the density is relatively high.

Specifically, for example, the untreated fibers are heated at a temperature of 450 to 550° C. in the heat treatment. In this case, recovery of the inorganic fiber paper after the compression heating can be effectively increased, while lowering in density of the inorganic fiber paper after compression heating being effectively suppressed. Further, if the crystallization temperature of the untreated fibers is higher than 550° C., embrittlement and lowering in bio-solubility of the heat-treated fibers after the heat treatment can be effectively avoided.

No specific restrictions are imposed on the heating time in the heat treatment (hereinafter referred to as the "heat treatment time") as long as it is in a range that the recovery after compression heating of the inorganic fiber paper containing the heat-treated fibers becomes higher than that of the inorganic fiber paper containing untreated fibers instead of the heat-treated fibers. Specifically, the heat treatment time is 1 minute to 48 hours, for example, and preferably 3 minutes to 24 hours.

In the paper-making step, inorganic fiber paper comprising the heat-treated fibers prepared in the above-mentioned heat treatment step and a binder is made.

Specifically, a raw material containing heat-treated fibers and a binder is prepared. No specific restrictions are imposed on a binder insofar as it can bond the heat-treated fibers, and one or both of an organic binder and an inorganic binder can be used.

Organic binders include one or two or more selected from the group consisting of acrylic resins such as arylic ester resins and styrene-acrylic acid resins, ethylene-vinyl acetate resins, vinyl acetate resins, styrene-butadiene resins, starch and acrylamide.

Inorganic binders include one or two or more selected from the group consisting of colloidal silica such as anionic colloidal silica and cationic colloidal silica, fumed silica, zirconia sol; titania sol, alumina sol, bentonite and kaolin.

In the raw Material (excluding a solvent), the content of the heat-treated fibers is 80 to 99.5 mass %, for example, and the content of a binder (one or both of an organic binder and an inorganic binder) is 0.5 to 20 mass %, for example. Further, it is preferred that the content of the heat-treated fibers be 85 to 99 mass % and the content of the binder be 1 to 15 mass %. It is more preferred that the content of the heat-treated fibers be 85 to 95 mass % and the content of the binder be 15 to 5 mass %.

In addition to the heat-treated fibers and the binder, the raw material may further contain other components. The raw material may further contain fire-resistant inorganic powder, for example. Fire-resistant inorganic powder includes ceramic powder such as silica, alumina, titania, zirconia, silicon nitride and silicon carbide and/or carbon powder such as carbon black. The content of other components is 5 mass % or less or 3 mass % or less relative to the total amount excluding the amount of the solvent, which will be described later.

The raw material is prepared by mixing the heat-treated fibers, a binder and, if need arises, other components, with a solvent. No specific restrictions are imposed on the solvent insofar as it can mix and disperse the heat-treated fibers and a binder, and examples thereof include water (distilled water, ion-exchanged water, tap water, ground water, industrial water, for example) and/or a polar organic solvent (monovalent alcohols such as ethanol and propanol and divalent alcohols such as ethylene glycol, for example). The solvent is preferably water. The raw material of the inorganic fiber paper thus obtained is a fluidic composition suitable for paper making (that is, slurry or the like).

In the paper-making step, inorganic fiber paper is made from the raw materials thus prepared. Paper making can preferably be conducted by means of a commercially-available paper-making apparatus, for example.

The inorganic fiber paper according to this embodiment (hereinafter referred to as the "the paper of the embodiment") is preferably produced by the method as mentioned above. That is, the paper of the embodiment Is inorganic fiber paper containing the above-mentioned heat-treated fiber and a binder.

The $SiO_2$ content of the heat-treated fibers contained in the paper of the embodiment is 50 to 82 mass %, for example. In this case, due to a relatively large $SiO_2$ content of the heat-treated fibers, the paper of the embodiment has improved heat resistance.

The CaO content of the heat-treated fibers contained in the paper of the embodiment is 10 to 34 mass %, for example. The inorganic fiber paper is $SiO_2$/CaO fibers having a $SiO_2$ content of 50 to 82 mass % and a CaO content of 10 to 34 mass %, for example.

The MgO content of the heat-treated fibers contained in the paper of the embodiment is 1 mass % or less, for example. The inorganic fiber paper is $SiO_2$/CaO fibers having a $SiO_2$ content of 50 to 82 mass %, a CaO content of 10 to 34 mass %, and MgO content of 1 mass % or less, for example.

In addition to those mentioned above, examples of the composition of the heat-treated fibers are as mentioned above.

As mentioned above, the paper of the embodiment contains one or both of an organic binder and an inorganic binder. That is, the paper of the embodiment may contain an organic binder and no inorganic binder, may contain an organic binder and an inorganic binder; and may contain no organic binder and may contain an inorganic binder.

The content of the heat-treated fibers and a binder in the paper of the embodiment is not particularly restricted, and is appropriately determined according to the application or the required properties thereof. For example, in the paper of the embodiment, the content of the heat-treated fibers is 80 to 99.5 mass %. More specifically, in the paper of the embodiment, the content of the heat-treated fibers is 90 to 98 mass % and the content of a binder is 2 to 10 mass %.

The thickness of the paper of the embodiment is not particularly restricted and appropriately determined according to the application or the required properties of the paper. The thickness of the paper of the embodiment is 0.1 to 8 mm, for example, preferably 0.5 to 6 mm.

The weight of the paper of the embodiment is not particularly restricted and appropriately determined according to the application or the required properties of the paper. The weight of the paper of the embodiment is 10 to 2800 g/m$^2$, for example, preferably 75 to 1800 g/m$^2$.

The density of the paper of the embodiment is not particularly restricted and appropriately determined according to the application or the required properties of the paper. The density of the paper of the embodiment is 0.1 to 0.35 g/cm$^3$, for example, preferably 0.15 to 0.3 g/cm$^3$.

The recovery after compression heating of the paper of the embodiment is remarkably improved due to the presence of the heat-treated fibers as the bio-soluble inorganic fibers. The paper of the embodiment has a recovery after compression heating of 60% or more, for example. More specifically, the recovery of the paper of the embodiment after heating at 500° C. for 3 hours in the compressed state such that the thickness thereof is reduced by 50% is 60% or more, for example. Specifically, the recovery is 60 to 100%, for example, preferably 60 to 80%. More preferably, the recovery is 60 to 70%.

The paper of the embodiment can be used in various applications. For example, the paper of the embodiment is used in equipment for heating and/or heat insulation. Specifically, the paper of the embodiment may be used as a sealant (e.g. a gasket) in a heat-treatment apparatus, an industrial furnace, an incinerator, a combustion device, a melting apparatus for aluminum, a hot water boiler, a hot water heater, a kitchen stove for domestic use, or the like, a NOx removal catalyst buffer and a kerosene heater wick.

Specific examples of this embodiment will be explained.

EXAMPLE 1

Production of Inorganic Fiber Paper

As the first bio-soluble inorganic fibers, amorphous $SiO_2$/CaO fibers with a $SiO_2$ content of 73 mass %, a CaO content of 21 to 26 mass %, a MgO content of 1 mass % or less and an $Al_2O_3$ content of 1 to 3 mass % (hereinafter referred to as the "fibers A") were prepared. The crystallization temperature of fibers A was 895° C.

As the second bio-soluble inorganic fibers, amorphous $SiO_2$/MgO fibers with a $SiO_2$ content of 76 mass %, a CaO content of 1 to 9 mass %, a MgO content of 14 to 22 mass % and an $Al_2O_3$ content of 1 to 2 mass % (hereinafter referred to as the "fibers B") were prepared. The crystallization temperature of fibers B was 857° C.

Fibers A and fibers B were independently subjected to heat treatments. The heat treatment temperatures were 300° C., 400° C., 500° C., 600° C., 700° C., 800° C., 900° C., 1000° C. or 1100° C. The heat treatment time was 3 hours.

Next, a sheet of inorganic fiber paper was produced. That is, 100 parts by weight of fibers A or fibers B which had been subjected to a heat treatment, 12 parts by weight of an acrylic resin (AG-100 with a solid content of 50%, manufactured by Showa Denko K.K.), 1.2 parts by weight of aluminum sulfate (a 0.2% solution, manufactured by Taimei Chemicals Co., Ltd.) and 0.1 part by weight of polyacrylamide (DS414: a 0.5% solution, manufactured by Seiko PMC Corporation) were mixed with 2000 parts by weight of water to prepare raw material slurry. By using a commercially-available paper-making machine, the raw material slurry was formed into paper, whereby a sheet of Inorganic fiber paper was produced.

A sheet of inorganic fiber paper was produced in the same manner as mentioned above, except that fibers A or fibers B which had not been subjected to a heat treatment were used instead of fibers A or fibers B which had been subjected to a heat treatment.

Each of the sheets of inorganic fiber paper had a thickness of 0.5 to 6 mm, a weight of 75 to 1800 g/m$^2$ and a density of 0.15 to 0.3 g/cm$^3$.

[Evaluation of Recovery]

The recovery of the thus produced inorganic fiber paper sheet after compression heating was evaluated. Specifically, from an appropriate part of each sheet of the inorganic fiber paper, 3 specimens with a dimension of 25 mm in width and 50 mm in length were cut out. The thickness (thickness before compression heating) was measured by means of a caliper.

Subsequently, taking the thickness before compression heating as 100%, each specimen was compressed until the thickness thereof was reduced by 50%. Further, each specimen in the compressed state was placed in an electric furnace of 500±15° C. and kept for 3 hours, whereby compression heating was conducted. Thereafter, each specimen was released from the compression heating.

The thickness of the specimen when 0.5 hour elapsed after the compression heating was released (the thickness after the compression heating) was measured by means of a caliper. The ratio (%) of the specimen thickness after the compression heating to the specimen thickness before the compression heating was calculated as the recovery.

FIG. 1 shows the results of evaluation of the recovery. In FIG. 1, the abscissa shows the heat treatment temperature (° C.) of the heat treatment applied to fibers A and fibers B contained in the inorganic fiber paper (however, the "untreated" means that fibers A and fibers B contained in the inorganic fiber paper were not subjected to a heat treatment) and the axis of ordinates shows the recovery (%) after compression heating of the inorganic fiber paper containing fibers A and fibers B which were subjected to a heat treatment at each heat treatment temperature. In FIG. 1, the black square mark indicates the recovery of the inorganic fiber paper containing fibers A and the white circle indicates the recovery of the inorganic fiber paper containing fibers B. The recovery shown by each mark is the arithmetical average value of the values obtained for 3 specimens.

As shown in FIG. 1, when the heat-treated fibers were used as fibers A and fibers B contained in the inorganic fiber paper (when the heat treatment temperature is 300 to 1100° C.), the recovery was higher as compared with the case where untreated fibers were used as fibers A and fibers B contained in the inorganic fiber paper (in the case indicated by the "untreated" in the FIGURE). It was confirmed that the recovery after compression heating was improved by using the heat-treated fibers as the bio-soluble inorganic fibers contained in the inorganic fiber paper.

When the heat treatment temperature was 900° C. or higher (that is, the heat treatment temperature was equal to or higher than the crystallization temperature of fibers A and fibers B), fibers A and fibers B contained in the inorganic fiber paper tended to be embrittled, compared to the case of the lower hest treatment temperatures. Further, when the heat treatment temperature was 600 to 900° C., the recovery exceeded 100%. That is, in this case, the inorganic fiber paper after compression heating was swollen and the density thereof was decreased.

On the other hand, a heat treatment temperature of 500° C. was particularly preferable, since it was possible to significantly improve the recovery of the inorganic fiber paper, while avoiding swelling of the inorganic fiber paper and embrittlement of the heat-treated fibers effectively.

Although only some exemplary embodiments and/or examples of this invention have been described in detail above, those skilled in the art will readily appreciate that many modifications are possible in the exemplary embodiments and/or examples without materially departing from the novel teachings and advantages of this invention. Accordingly, all such modifications are intended to be included within the scope of this invention.

The documents described in the specification are incorporated herein by reference in its entirety.

The invention claimed is:

1. Inorganic fiber paper comprising: bio-soluble inorganic fibers which have the following compositions:

$SiO_2$: 66 to 82 wt %
CaO: 1 to 9 wt %
MgO: 10 to 30 wt %
$Al_2O_3$: 1 to 3 wt %, and which have been subjected to a heat treatment at a temperature at least 400° C., but lower than the crystallization temperature of the fibers, and a binder, which paper exhibits recovery after compression-heating of at least 60% of its pre-compression-heating thickness, said compression-heating having comprised compressing a specimen of the paper until its pre-compression-heating thickness was reduced by 50%, and maintaining the specimen in the compressed state at 500±15° C. for 3 hours, and 0.5 hour after releasing the specimen from the compression-heating, measuring the thickness of the specimen.

2. Inorganic fiber paper comprising: bio-soluble inorganic fibers which have the following composition:

$SiO_2$: 66 to 82 wt %
CaO: 10 to 34 wt %
MgO: 3 wt % or less
$Al_2O_3$: 1 to 5 wt %, and which have been subjected to a heat treatment at a temperature at least 400° C., but lower than the crystallization temperature of the fibers, and a binder, which paper exhibits recovery after compression-heating of at least 60% of its pre-compression-heating thickness, said compression-heating having comprised compressing a specimen of the paper until its pre-compression-heating thickness was reduced by 50%, and maintaining the specimen in the compressed state at 500±15° C. for 3 hours, and 0.5 hour after releasing the specimen from the compression-heating, measuring the thickness of the specimen.

3. The inorganic fiber paper according to claim 2 wherein the content of $Al_2O_3$ is 1 to 3 wt %.

4. Inorganic fiber paper comprising bio-soluble inorganic fibers which comprise:

$SiO_2$: 66 to 82 wt %
CaO: 1 to 9 wt %
MgO: 10 to 30 wt %
$Al_2O_3$: 3 wt % or less and which have been subjected to a heat treatment at a temperature at least 400° C., but lower than the crystallization temperature of the fibers, and a binder, which paper exhibits recovery after compression-heating of at least 60% of its pre-compression-heating thickness, said compression-heating having comprised compressing a specimen of the paper until its pre-compression-heating thickness was reduced by 50%, and maintaining the specimen in the compressed state at 500±15° C. for 3 hours, and 0.5 hour after releasing the specimen from the compression-heating, measuring the thickness of the specimen.

5. The inorganic fiber paper according to claim 4 wherein the recovery after the compression heating is 60% to 80%.

6. Inorganic fiber paper comprising bio-soluble inorganic fibers which comprise:

$SiO_2$: 66 to 82 wt %
CaO: 10 to 34 wt %
MgO: 3 wt % or less
$Al_2O_3$: 5 wt % or less
other oxides: 2 wt % or less and which have been subjected to a heat treatment at a temperature at least 400° C., but lower than the crystallization temperature of the fibers, and a binder, which paper exhibits recovery after compression-heating of at least 60% of its pre-compression-heating thickness, said compression-heating having comprised compressing a specimen of the paper until its pre-compression-heating thickness was reduced by 50%, and maintaining the specimen in the compressed state at 500±15° C. for 3 hours, and 0.5 hour after releasing the specimen from the compression-heating, measuring the thickness of the specimen.

7. The inorganic fiber paper according to claim 6 wherein the recovery after the compression heating is 60% to 80%.

* * * * *